US007124840B2

(12) United States Patent
Miyakawa

(10) Patent No.: US 7,124,840 B2
(45) Date of Patent: Oct. 24, 2006

(54) ENGINE BREAKER

(75) Inventor: Shigeru Miyakawa, Kobe (JP)

(73) Assignee: Yamada Machinery Industrial Co., Ltd., Hyogo (JP)

( * ) Notice: Subject to any disclaimer, the term of this patent is extended or adjusted under 35 U.S.C. 154(b) by 0 days.

(21) Appl. No.: 10/494,858

(22) PCT Filed: Nov. 8, 2002

(86) PCT No.: PCT/JP02/11705

§ 371 (c)(1),
(2), (4) Date: May 6, 2004

(87) PCT Pub. No.: WO03/039815

PCT Pub. Date: May 15, 2003

(65) Prior Publication Data

US 2005/0016744 A1 Jan. 27, 2005

(30) Foreign Application Priority Data

Nov. 9, 2001 (JP) ..... 2001-344728

(51) Int. Cl.
*B25D 17/24* (2006.01)

(52) U.S. Cl. ..... 173/162.1; 173/211

(58) Field of Classification Search ..... 173/211, 173/210, 162.1, 162.2, 118, 93.7, 100, 122, 173/171.1

See application file for complete search history.

(56) References Cited

U.S. PATENT DOCUMENTS 1,191,948 A * 7/1916 Coates ..... 74/583
3,224,473 A * 12/1965 Dobbertin et al. ..... 30/383
3,525,373 A * 8/1970 Kobayashi ..... 30/381
3,559,751 A * 2/1971 Yamada ..... 173/201
3,570,608 A * 3/1971 Erma ..... 173/201
3,698,455 A * 10/1972 Frederickson et al. ..... 30/381
3,772,784 A * 11/1973 Heermann ..... 30/382
3,785,465 A * 1/1974 Johansson ..... 192/48.5
3,889,763 A * 6/1975 Dillon ..... 173/162.1
3,918,534 A * 11/1975 Fogelholm ..... 173/162.1
3,972,119 A * 8/1976 Bailey ..... 30/381
4,010,544 A * 3/1977 Siman ..... 30/381
4,014,392 A * 3/1977 Ross ..... 173/118
4,141,143 A * 2/1979 Hirschkoff et al. ..... 30/381
4,285,405 A * 8/1981 Weir, Jr. ..... 173/162.1
6,026,909 A * 2/2000 Hon ..... 173/162.1

FOREIGN PATENT DOCUMENTS

JP 56-156927 4/1981
JP 62-27226 2/1987
JP 11-188663 7/1999

* cited by examiner

*Primary Examiner*—Stephen F. Gerrity
*Assistant Examiner*—Paul Durand
(74) *Attorney, Agent, or Firm*—Hamre, Schumann, Mueller & Larson, P.C.

(57) ABSTRACT

An engine breaker includes a vertically extending cylindrical main body (1), a work member (2) supported by a lower portion of the main body for up and down movement, an engine (5) mounted to an upper portion of the main body and having an output shaft arranged to extend horizontally, and a striker (30) incorporated in the main body (1) for successively striking an upper end of the work member (2) through rotation of a horizontally extending rotary shaft (6) to which rotation output of the engine (1) is transmitted. The engine (5) includes a housing (5*a*) supported by the main body (1) via a resilient member (8), and a flexible coupling (9, 9A, 9B) for absorbing vibration in a direction crossing the rotary shaft (6) is interposed between the output shaft (52) and the rotary shaft (6).

4 Claims, 8 Drawing Sheets

ENGINE BREAKER

TECHNICAL FIELD

The present invention relates to a breaker driven by an engine mounted to the main body.

BACKGROUND ART

A breaking apparatus generally called a concrete breaker is used for breaking a hard object such as asphalt or concrete at a road construction site or a building construction site, for example. In a typical breaker, an engine mounted at an upper portion of the main body drives a striker. The striker, when driven, causes a work member supported by a lower portion of the main body to move up and down to break the hard object. FIG. 9 illustrates an example of prior art engine breaker. The engine breaker 100 includes a vertically extending cylindrical main body 1, a work member 2 supported by a lower portion of the main body for up and down movement, an engine 105 mounted to an upper portion of the main body 1, and a striker 30 incorporated in the main body 1 for successively striking an upper end of the work member 2 by the driving of the engine 105.

The main body 1 includes a cylindrical member 11, and a crank case 12 mounted to an upper portion of the cylindrical member 11. The cylindrical member 11 and the crank case 12 incorporate a hammer 3 and a crank mechanism 4, respectively, which will be described later. The work member 2 may be a chisel having a drill-like tip end, and a base end inserted in the cylindrical member 11.

The engine 105 is so arranged that the output shaft thereof extends horizontally and transmits the rotation output to a rotary shaft 6 incorporated in the crank case 12 of the main body 1. The rotary shaft 6 is so arranged in the crank case 12 as to extend horizontally. The engine 105 is mounted to the main body 1 via an engine mount plate 7*a* having an L-shaped cross section. Specifically, a side surface and a lower surface of a housing of the engine 105 are screwed to the engine mount plate 7*a*, and the engine mount plate 7*a* in this state is screwed to a side surface of the crank case 12 of the main body 1. As the engine 105, a two-cycle engine with a displacement of about 50 cc is generally used.

The striker 30 includes a crank mechanism 4 operated by the rotation of the rotary shaft 6, and a hammer 3 which moves up and down by the operation of the crank mechanism 4. The hammer 3 has a front end for contacting the work member 2.

Unlike a breaker in which a hammer 3 moves up and down by utilizing an expansion force of compressed air, the engine breaker 100 is not connected to an external apparatus such as a compressor for generating compressed air, and hence is relatively easy to handle.

In the engine breaker 100, however, the main body 1 vibrates much due to the reaction in moving the hammer 3 by the crank mechanism 4 and the impact in striking the work member 2 with the hammer 3. As a result, the housing of the engine 105 mounted to the main body 1 may be deformed at a portion close to the main body 1 or the engine 105 itself may vibrate to result in a change in the positional relationship between the structural parts of the engine disposed inside or outside of the housing. Such a condition may lead to the malfunction or failure of the engine 105. Therefore, to enhance the durability of the engine breaker 100, the wall thickness of the housing of the engine 105 may be made to about 5 to 6 mm, which is considerably larger than the wall thickness (2 to 3 mm) of a general two-cycle engine with a displacement of about 50 cc. Therefore, such a general engine cannot be used as the engine 100, which leads to an increase of the manufacturing cost of the engine breaker 100. Further, the weight of the engine 105 having a housing made of diecast aluminum becomes about 8 kg, which is considerably larger than the weight (about 3 kg) of a general engine. In this way, the large wall thickness of the housing makes it difficult to reduce the weight of the engine breaker 100.

DISCLOSURE OF THE INVENTION

An object of the present invention, which is conceived under the circumstances described above, is to provide a vibration-resistant engine breaker capable of preventing the malfunction or failure of the engine due to the vibration in use.

According to a first aspect of the present invention, there is provided an engine breaker comprising a vertically extending cylindrical main body, a work member supported by a lower portion of the main body for up and down movement, an engine mounted to an upper portion of the main body and having an output shaft arranged to extend horizontally, and a striker incorporated in the main body for successively striking an upper end of the work member through rotation of a horizontally extending rotary shaft to which rotation output of the engine is transmitted. The engine includes a housing supported by the main body via a resilient member, and a flexible coupling for absorbing vibration in a direction crossing the rotary shaft is interposed between the output shaft and the rotary shaft.

Herein, the flexible coupling means a coupling which connects two shafts together for the transmission of the rotational force therebetween while permitting the movement of at least one of the shafts in the crossing direction.

In a preferred embodiment, the striker includes a crank mechanism operated by rotation of the rotary shalt, and a hammer which moves up and down by the operation of the crank mechanism.

In a preferred embodiment, the housing of the engine includes a side surface and a lower surface respectively supported, via the resilient member, by a side surface of the main body and an engine bracket standing from the side surface of the main body, the resilient member comprising a plurality of resilient pieces made of a resilient material.

In a preferred embodiment, the flexible coupling comprises a vibration absorber made of a resilient material and interposed between the rotary shaft and an output transmitting portion provided at the output shaft of the engine for transmitting output to the rotary shaft.

In a preferred embodiment, the vibration absorber is fitted around an end of the rotary shaft and has an end surface contacting and fixed to the output transmitting portion.

In a preferred embodiment, the engine breaker further comprises an engine mount plate for mounting the engine to the main body, and the engine mount plate is provided with a bearing arranged between the side surface of the engine and the side surface of the main body. The output transmitting portion has an end in the form of a boss fitted in the bearing and having an inner circumferential surface formed with a plurality of radially extending first projections. The rotary shaft has an end formed with a plurality of axially extending second projections provided correspondingly to the first projections, and each of the second projections is received in the boss end of the output transmitting portion and located between adjacent first projections. The vibration absorber includes a plurality of vibration absorbing portions each of which is arranged between a side surface of a respective first projection and a side surface of the adjacent second projection in the boss end of the output transmitting portion.

Other features and advantages of the present invention will become clearer from the description of the preferred embodiment given below.

BEST MODE FOR CARRYING OUT THE INVENTION

Preferred embodiments of the present invention will be described below with reference to FIGS. 1–8. In these figures, the members or parts which are similar to those of the prior art structure shown in FIG. 9 are designated by the same reference signs as those used for the prior art structure.

Figure 1:
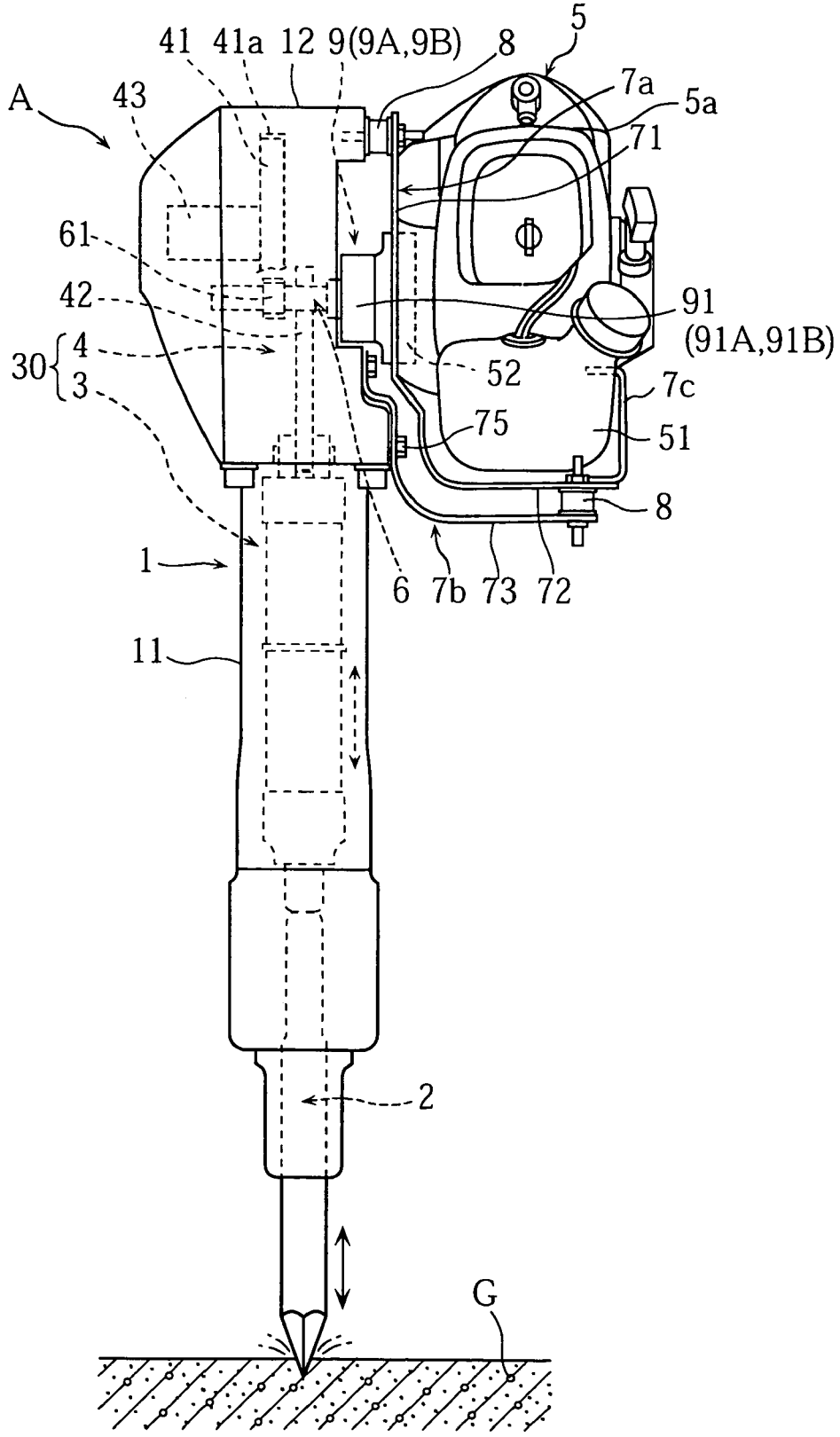
FIG. 1 is a side view illustrating an example of engine breaker according to the present invention.

Referring to FIG. 1, an engine breaker A is generally used to break a hard object G such as asphalt or concrete at a road construction site or a building construction site, for example. The engine breaker includes a vertically extending, generally cylindrical main body 1, a work member 2 supported by a lower portion of the main body 1 for up and down movement, a striker 30 incorporated in the main body 1 for successively striking an upper end of the work member 2, and an engine 5 mounted to an upper portion of the main body 1 for driving the striker 30.

Figure 2:
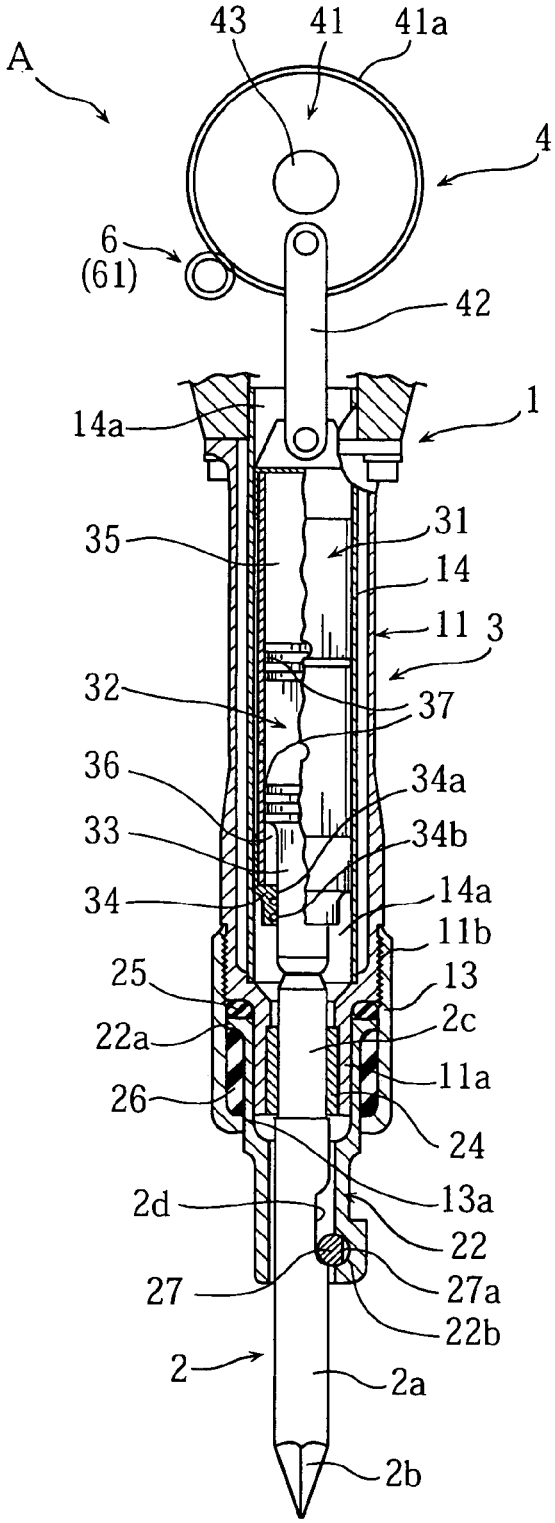
FIG. 2 is a front view illustrating the internal structure of the engine breaker of FIG. 1.

The main body 1 includes a cylindrical member 11, and a crank case 12 mounted to an upper portion of the cylindrical member 11, which are made of a metal having certain rigidity, for example. As shown in FIG. 2, the cylindrical member 11 has a lower portion which is formed with a boss 11*a* and hence has a smaller inner diameter. A shank 2*c* of the work member 2, which will be described later, is received in the boss 11*a* for vertical sliding movement via a bush 24. Around the boss 11*a* is fitted a base end of a cylindrical work member holder 22. The work member holder 22 has a front end holding a body 2*a* of the work member 2 for up and down movement. The lower portion of the cylindrical member 11A has an outer surface formed with a male thread 11*b*. A lower cap 13 is attached to the lower portion by mating with the male thread. The lower cap 13 has a front end formed with a through-hole 13*a* from which the work member holder 22 (and the work member 2) projects.

The work member holder 22 can slide up and down while being guided along the outer surface of the boss 11*a* and the through-hole 13*a* of the lower cap 13. The base end of the work member holder 22 is formed with a flange 22*a* for sliding engagement with an inner circumferential surface of the lower cap 13. On the flange 22*a* is provided an annular resilient member 25 fitted in an annular space between the boss 11*a* and the lower cap 13, whereas under the flange 22*a* is provided an annular resilient member 26 fitted in an annular space between the work member holder 22 and the lower cap 13.

Figure 5:
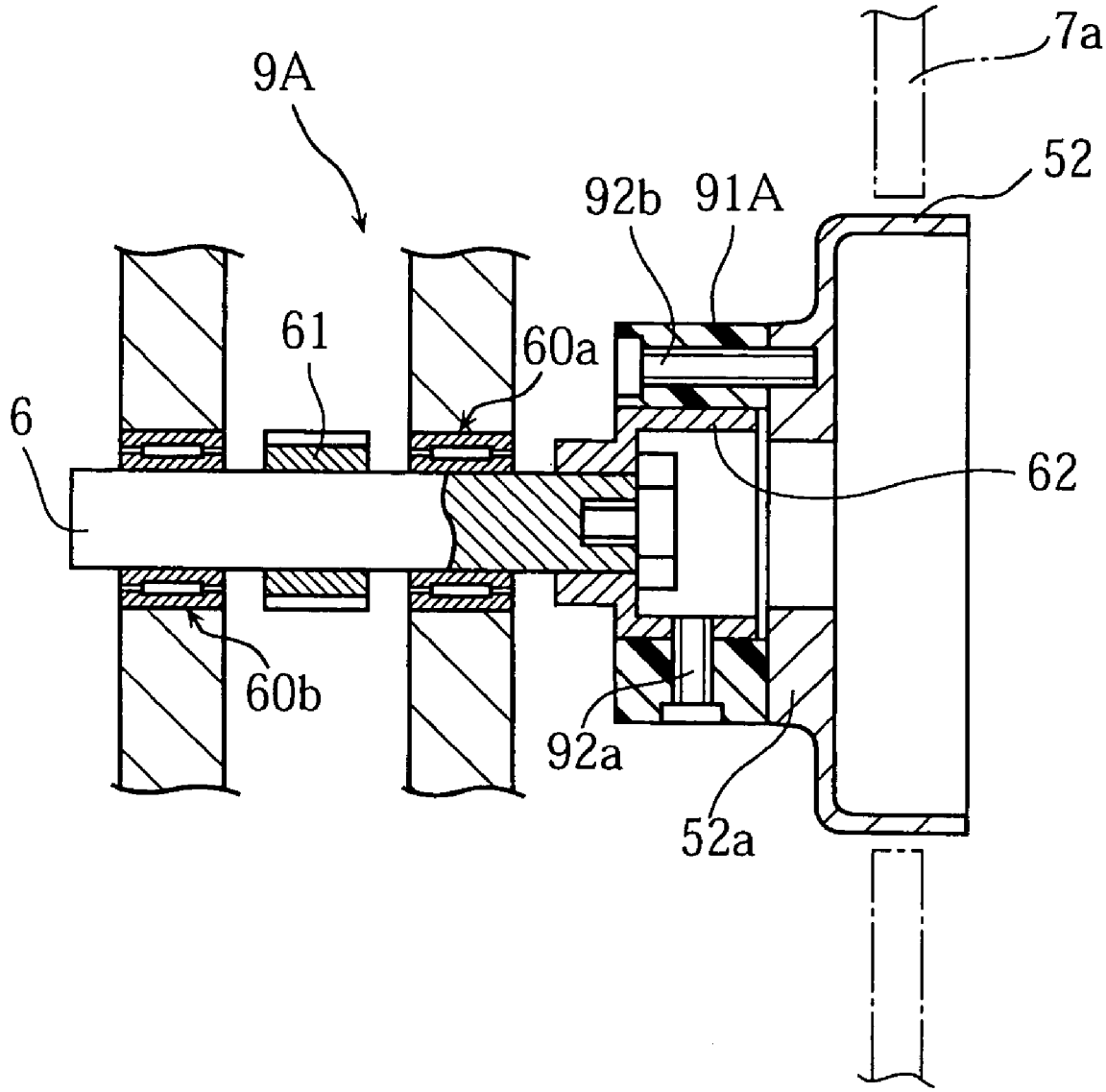
FIG. 5 is a sectional view taken along lines V—V in FIG. 4.

The cylindrical member 11 incorporates therein a stationary cylinder 14 so that the cylindrical member 11 overlaps the stationary cylinder. The stationary cylinder 14 defines therein a cylinder space 14*a* communicating with an internal space of the crank case 12. The internal space of the crank case 12 and the cylinder space 14*a* accommodate a crank mechanism 4 and a hammer 3 of the striker 30, respectively., As shown in FIG. 1, in the internal space of the crankcase 12*a*, a rotary shaft 6 to which rotation output of the engine 5 is to be transmitted is arranged to extend horizontally. The rotary shaft 6 is provided with a pinion gear 61 having a relatively small diameter. As shown in FIG. 5, the rotary shaft 6 is held by roller bearings 60*a* and 60*b* at opposite sides of the pinion gear 61, for example.

The work member 2 in this embodiment comprises a chisel suitable for breaking asphalt or concrete and made of a metal having certain rigidity, for example. As shown in FIG. 2, the work member 2 is generally columnar and made up of the body 2*a* as a central portion, a drill-like cutter portion 2*b* provided on the front-end side, and the shank 2*c* provided on the base-end (upper-end) side and having a smaller diameter than that of the body 2*a*. The body 2*a* has a circumferential surface formed with a flat portion 2*d*. The work member holder 22 is formed with a hole 22*b* extending in the direction of the sheet surface of FIG. 2 and having an inner surface exposed to the inner circumferential surface of the work member holder 22. The work member 2 is so arranged that the flat portion 2*d* faces the inner surface of the hole 22*b*, and a stopper pin 27 having a predetermined thickness is inserted in the hole 22*b*, whereby the work member 2 is prevented from dropping from the work member holder 22. The work member 2 is movable up and down relative to the work member holder 22 within the range of the axial length of the flat portion 2*d*.

The stopper pin 27 is formed with a segmental cutout 27*a*. Thus, by appropriately turning the stopper pin 27, it is possible to select a state in which the work member 2 is prevented from dropping or another state in which the dropping is allowed.

As shown in FIG. 1, the striker 30 is made up of the crank mechanism 4 operated by the rotation of the rotary shaft 6, and the hammer 3 which moves up and down by the operation of the crank mechanism 4. The crank mechanism 4 functions to convert the rotary motion of the output shaft of the engine 5 into reciprocal linear motion, and includes a crank plate 41 which rotates in accordance with the rotation of the rotary shaft 6, and a rod 42 connecting the crank plate 41 and the hammer 3 to each other, as shown in FIG. 2. The crank plate 41 rotates about a crank shaft 43 (See FIG. 1) rotatably held at a predetermined position in the crank case 12 by e.g. a non-illustrated bearing. The crank plate has a circumferential surface formed with a gear portion 41*a* for engagement with the pinion gear 61. The rod 42 has opposite ends pivotally connected to the crank plate 41 and an upper end of a movable cylinder 31 of the hammer 3, respectively.

The hammer 3 is made up of the movable cylinder 31 inserted in the stationary cylinder 14 for up and down movement, a free piston 32 inserted in the movable cylinder 31 for up and down movement, and a striking bar 33 integrally formed on and projecting from a lower portion of the free piston 32. As noted above, the movable cylinder 31 is connected to the rod 42 of the crank mechanism 4 and moves up and down in accordance with the rotation of the crank plate 41. The movable cylinder 31 has a closed upper end, and a lower end to which a cap 34 is attached. The cap is formed with a through-hole 34*a* for allowing the striking bar 33 to project downward therethrough.

The free piston 32 has a generally columnar configuration having an upper and a lower surfaces. Between the upper surface of the free piston and an upper wall of the movable cylinder 31 is defined an upper pneumatic chamber 35, whereas between the lower surface of the free piston 32 and the cap 34 attached to the movable cylinder 31 is defined a lower pneumatic chamber 36. An O-ring 37 is fitted around the free piston 32 to hermetically seal between the outer circumferential surface of the free piston 32 and the inner circumferential surface of the movable cylinder 31.

The striking bar 33 is smaller in outer diameter than the free piston 32. When the free piston 32 moves downward, the striking bar projects through the through-hole 34*a* of the cap 34 of the movable cylinder 31 to strike the upper end of the work member 2. Between the outer circumferential surface of the striking bar 33 and the inner circumferential surface of the through-hole 34*a* is hermetically sealed with an O-ring 34*b* fitted in the through-hole 34*a*. In this way, each of the upper pneumatic chamber 35 and the lower pneumatic chamber 36 is hermetically sealed.

When the movable cylinder 31 moves up and down, the free piston 32 moves up and down following the movement of the movable cylinder 31. When the movable cylinder 31 moves from the lower dead point to the upper dead point, the lower pneumatic chamber 36 is once compressed due to the inertial delay of the free piston 32. Thereafter, the free piston 32 moves upward with the aid of the expansion force of the compressed lower pneumatic chamber 36. After reaching the upper dead point, the movable cylinder 31 moves downward. At this time, the upper pneumatic chamber 35 is compressed greatly by the upward movement of the free piston 32 due to the inertial delay and the inertial force. Subsequently, the expansion force of the compressed upper pneumatic chamber 35 and the downward movement of the movable cylinder 31 cause the free piston 32 to move downward at high speed. As a result, the striking bar 33 strikes the upper end of the work member 2. By repeating such operation, the striking by the striking bar 33 is performed successively.

As noted above, by the up and down movement of the movable cylinder 31, the speed at which the free piston 32 moves downward is increased particularly due to the expansion force of the compressed upper pneumatic chamber 35. Therefore, a high impact force can be successively applied to the work member 2.

The engine 5 is a small two-cycle engine with a displacement of 30–50 cc and includes a housing 5*a* made of diecast aluminum. The housing 5*a* has a wall thickness of 2 to 3 mm, which is smaller than that of the prior art structure, whereby the weight of the engine breaker A can be reduced. As the engine 5, use may be made of a general inexpensive engine such as an engine for a mowing machine or a pump engine, which are widely available in the market. Therefore, the manufacturing cost of the engine breaker A can be reduced. As shown in FIG. 1, the engine 5 is provided, at a lower portion thereof, with a fuel tank 51, and the lower surface of the housing is located at a generally intermediate position in the vertical direction.

As shown in FIG. 1, the engine 5 is so arranged that the output shaft extend horizontally. The housing 5*a* is mounted to the main body 1 (crank case 12) via resilient members 8. The resilient members 8 are resilient pieces made of a resilient material such as rubber. Specifically, the engine 5 is mounted to the main body 1*a* via an engine mount plate 7*a* for connecting between a side surface of the housing 5*a* of the engine 5 and a side surface of the main body 1, a stay 7*c* for supporting the lower surface of the housing of the engine 5, and an engine bracket 7*b* standing from the side surface of the main body 1.

Figure 3:
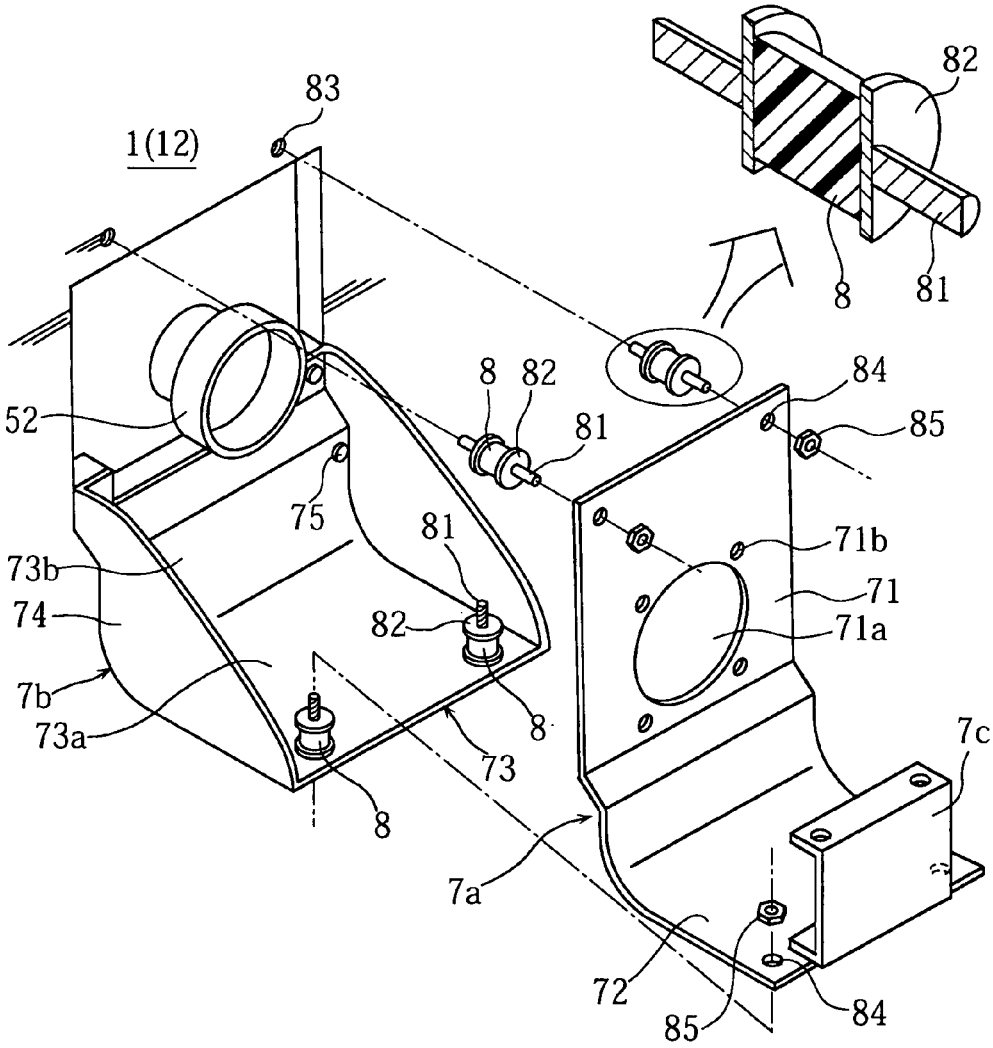
FIG. 3 is a perspective view illustrating a principal portion of FIG. 1 as enlarged.

As shown in FIG. 1, the engine mount plate 7*a* has a generally L-shaped cross section and may be made by bending a metal plate, for example. The engine mount plate 7*a* includes a surface 71 and a surface 72 respectively corresponding to the side surface and the lower surface of the housing of the engine 5. As shown in FIG. 3, the surface 71 is perforated with an insertion hole 71*a* for inserting a clutch drum 52 of the engine 5, which will be described later. Around the insertion hole 71*a* is formed a plurality of screw holes 71*b* for fixing the engine mount plate 7*a* to the engine 5. The engine mount plate 7*a* is fixed to the side surface of the housing 5*a* of the engine 5 with e.g. bolts (not shown) inserted into the screw holes 71*b*. The plane 72 extends along the lower surface of the fuel tank 51 (See FIG. 1) of the engine 5 and is fixed to the lower surface of the housing 5*a* of the engine 5 via the stay 7*c*.

The stay 7*c* may be formed by bending e.g. a metal plate into a channel shape. The stay 7*c* is screwed to the lower surface of the housing 5*a* of the engine 5 and the surface 72 of the engine mount plate 7*a*.

As shown in FIG. 1, the engine bracket 7*b* supports the engine 5 from below and is fixed to the side surface of the main body 1 (crank case 12) with screws 75, for example. As shown in FIG. 3, the engine bracket 7*b* comprises a bent plate 73 including a horizontal surface 73*a* and a vertical surface 73*b* and hence having an L-shaped cross section, and a pair of side plates 74 attached to opposite side edges of the bent plate 73, so that the engine bracket is unlikely to be bent easily. It is to be noted that only the bent plate 73 of the engine bracket 7*b* is illustrated in FIG. 1.

In mounting the engine 5 to the main body 1 (crank case 12), the engine 5 is first fixed to the engine mount plate 7*a*, and the stay 7*c* is attached to a predetermined position. Subsequently, as shown in FIG. 3, the surface 71 of the engine mount plate 7*a* is fixed to the side surface of the main body 1 via two resilient members 8, while the surface 72 of the engine mount plate 7*a* is fixed to the horizontal surface 73*a* of the bent plate 73 of the engine bracket 7*b* via two resilient members 8. In this embodiment, each of the resilient members 8 has a columnar configuration having opposite end surfaces, and a metal plate 82 provided with a threaded pin 81 projecting therefrom is bonded to each of the opposite end surfaces by vulcanization bonding, for example. With this arrangement, strong adhesion is provided between the resilient member 8 and the metal plate 82 by the application of an adhesive between these parts and the vulcanization of the resilient member 8. Therefore, even when a relatively large load is applied in the direction along the bond interface, these parts are unlikely to separate from each other. In attaching each of the resilient members 8 to which the metal plates 82 have been bonded in the above-noted manner, the threaded pin 81 is inserted into a screw hole 83 formed in the side surface of the main body 1 or inserted into a screw hole 84 formed in the surface 71, 72 of the engine mount plate 7*a* or the horizontal surface 73*a* of the engine bracket 7*b* and then a nut 85 is screwed onto the pin.

In this way, the side and the lower side of the housing 5*a* of the engine 5 are fixed to the side surface of the main body 1 and to the engine bracket 7*b*, respectively, via the resilient members 8. Therefore, the vibration of the main body 1 is absorbed by the resilient members 8 and is prevented from being transmitted to the engine 5. Thus, strong vibration of the engine 5 can be avoided.

In absorbing the vibration of the main body 1, each of the resilient members 8 is temporarily deformed, which causes positional deviation of the rotary shaft 6 arranged in the main body 1 relative to the engine 5. At this time, if the output shaft of the engine 5 is directly connected to the rotary shaft 6, a load is applied in the direction crossing the rotary shaft 6, which may results in the breakage at the connection portion. To avoid such a problem, in the engine breaker A, a flexible coupling 9 is interposed between the output shaft of the engine 5 and the rotary shaft 6, as shown in FIG. 1. The flexible coupling means a coupling which connects two shafts together for the transmission of the rotational force therebetween while permitting the movement of at least one of the shafts in the crossing direction.

In this embodiment, the engine 5 is provided with a centrifugal clutch. The output shaft of the engine 5 is provided with a generally cylindrical clutch drum as an output transmitting portion 52 for transmitting output to the rotary shaft 6. The flexible coupling 9 serves to absorb vibration in the direction crossing the rotary shaft 6, and includes a vibration absorber 91 made of a resilient member and interposed between the clutch drum (output transmitting portion) 52 and the rotary shaft 6.

Figure 4:
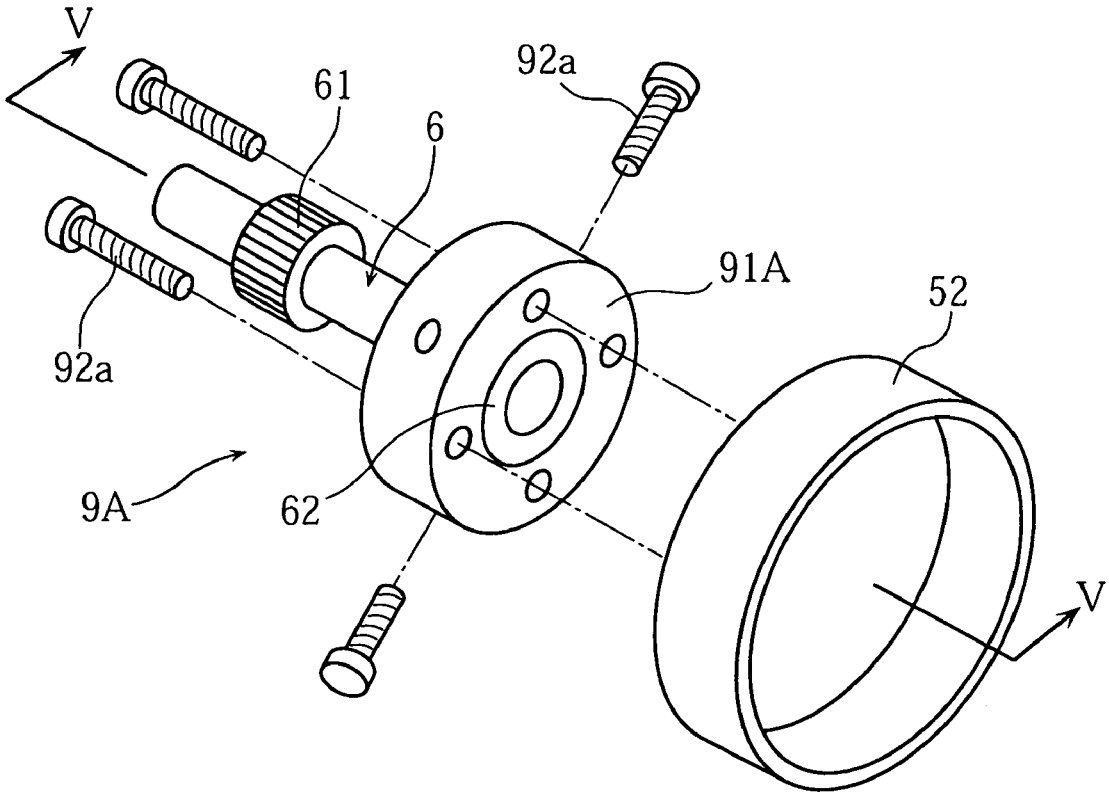
FIG. 4 is an enlarged perspective view illustrating an example of flexible coupling of FIG. 1.

FIGS. 4 and 5 illustrate an example of flexible coupling 9. The illustrated flexible coupling 9A includes a generally cylindrical vibration absorber 91A fitted around an end of the rotary shaft 6. The vibration absorber 91A has an end surface contacting and fixed to the clutch drum 52.

Specifically, a hub 62 is attached to the end of the rotary shaft 6, and the vibration absorber 91A of the flexible coupling 9A is fitted around the hub 62. The vibration absorber 91A is fixed to the hub 62 by threading a first screw 92*a* radially into the hub 62, whereby the vibration absorber is prevented from moving relative to the rotary shaft 6 in the axial direction or rotating about the rotary shaft 6. The end surface of the clutch drum 52 on the side of the rotary shaft 6 is formed with a thick wall portion 52*a*. The end surface of the vibration absorber 91A is held in contact with the thick wall portion 52*a*. The vibration absorber 91A is fixed to the clutch drum 52 by threading a second screw 92*b* into the thick wall portion 52*a* in the axial direction. Therefore, the rotary shaft 6 rotates in accordance with the rotation of the clutch drum 52. The thickness of the vibration absorber 91A is so set that the hub 62 does not come into contact with the thick wall portion 52*a* when the vibration absorber is fixed to the hub 62 and the thick wall portion 52*a*.

In this way, in the flexible coupling 9A, the clutch drum 52 (thick wall portion 52*a*) is not directly connected to the rotary shaft 6 (hub 62) but connected via the vibration absorber 91A. Therefore, when the positional deviation of the rotary shaft 6 relative to the clutch drum 52 occurs, the vibration absorber 91A is deformed to reduce the load applied to the connection portion in the direction crossing the rotary shaft 6. Further, by removing the first screw 92*a* and the second screw 92*b*, the engine 5 and the rotary shaft 6 can be easily separated from each other for maintenance, for example. In the vibration absorber 91A, the portions corresponding to the first screw 92*a* and the second screw 92*b* may comprise a block made of e.g. metal for preventing the breakage of the vibration absorber 91A.

Figure 6:
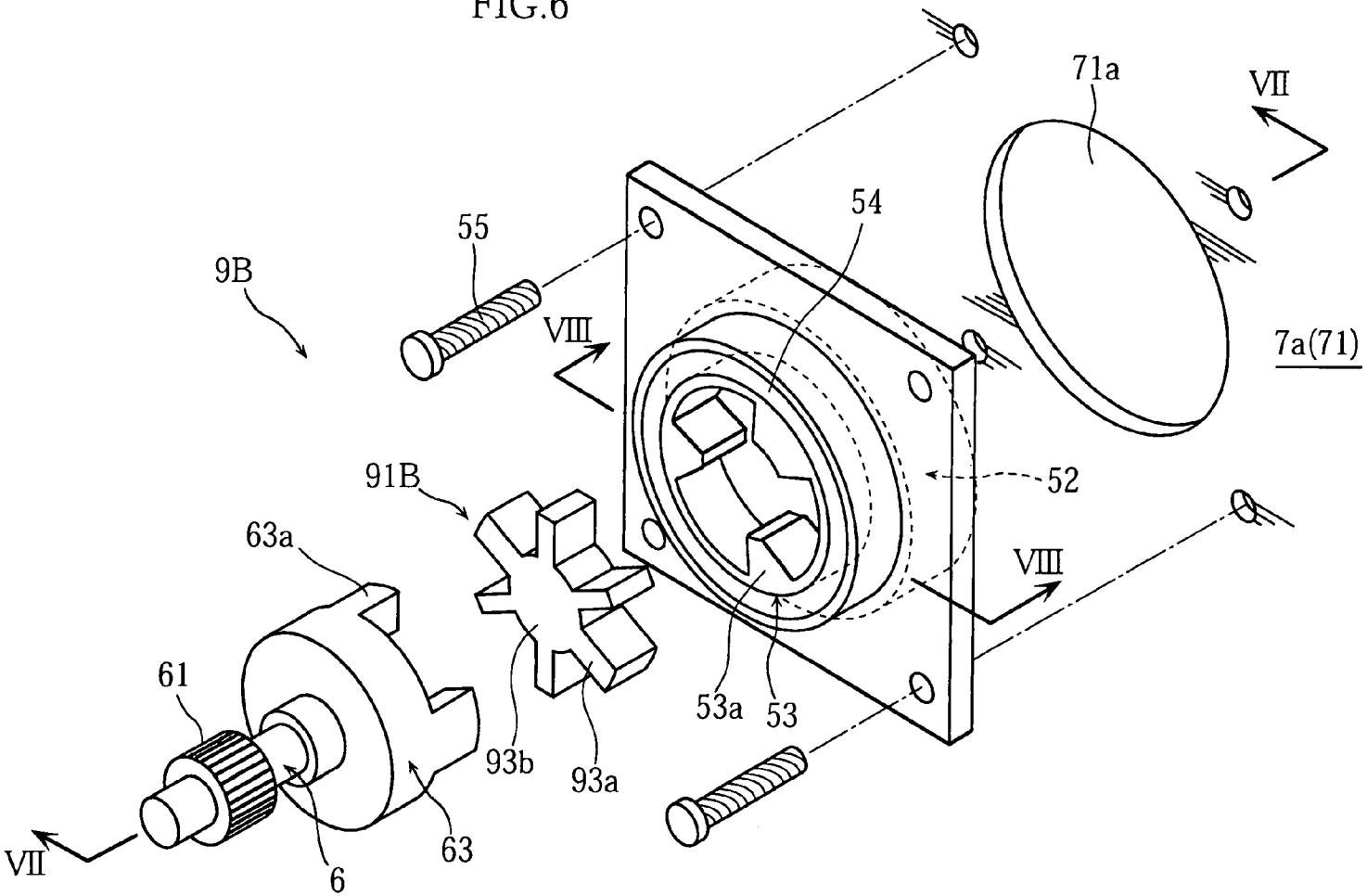
FIG. 6 is an enlarged perspective view illustrating another example of flexible coupling of FIG. 1.
Figure 7:
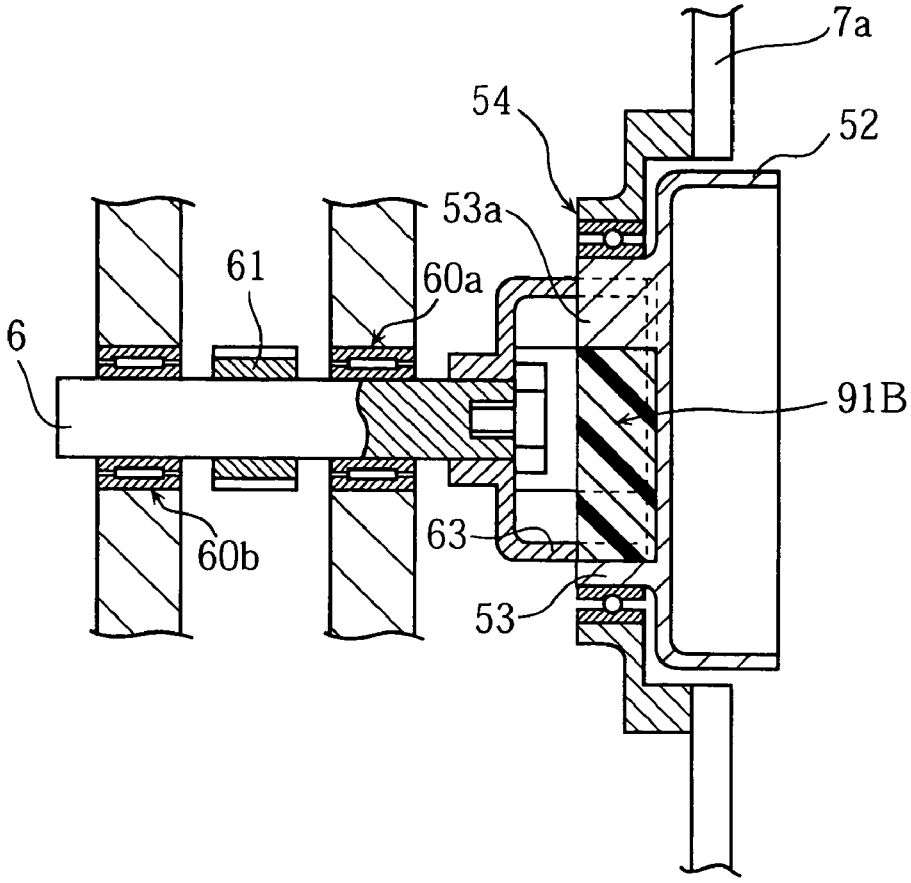
FIG. 7 is a sectional view taken along lines VII—VII in FIG. 6.
Figure 8:
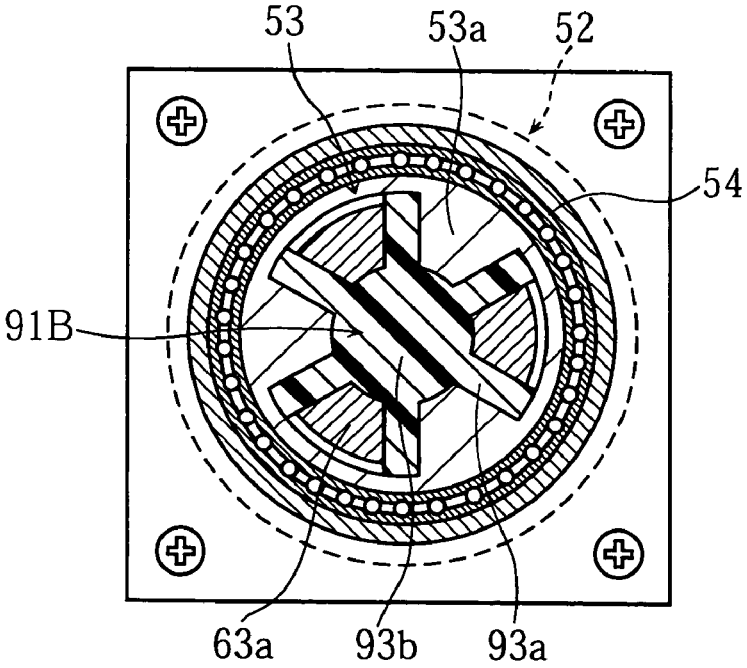
FIG. 8 is a sectional view taken along lines VIII—VIII in FIG. 6.
Figure 9:
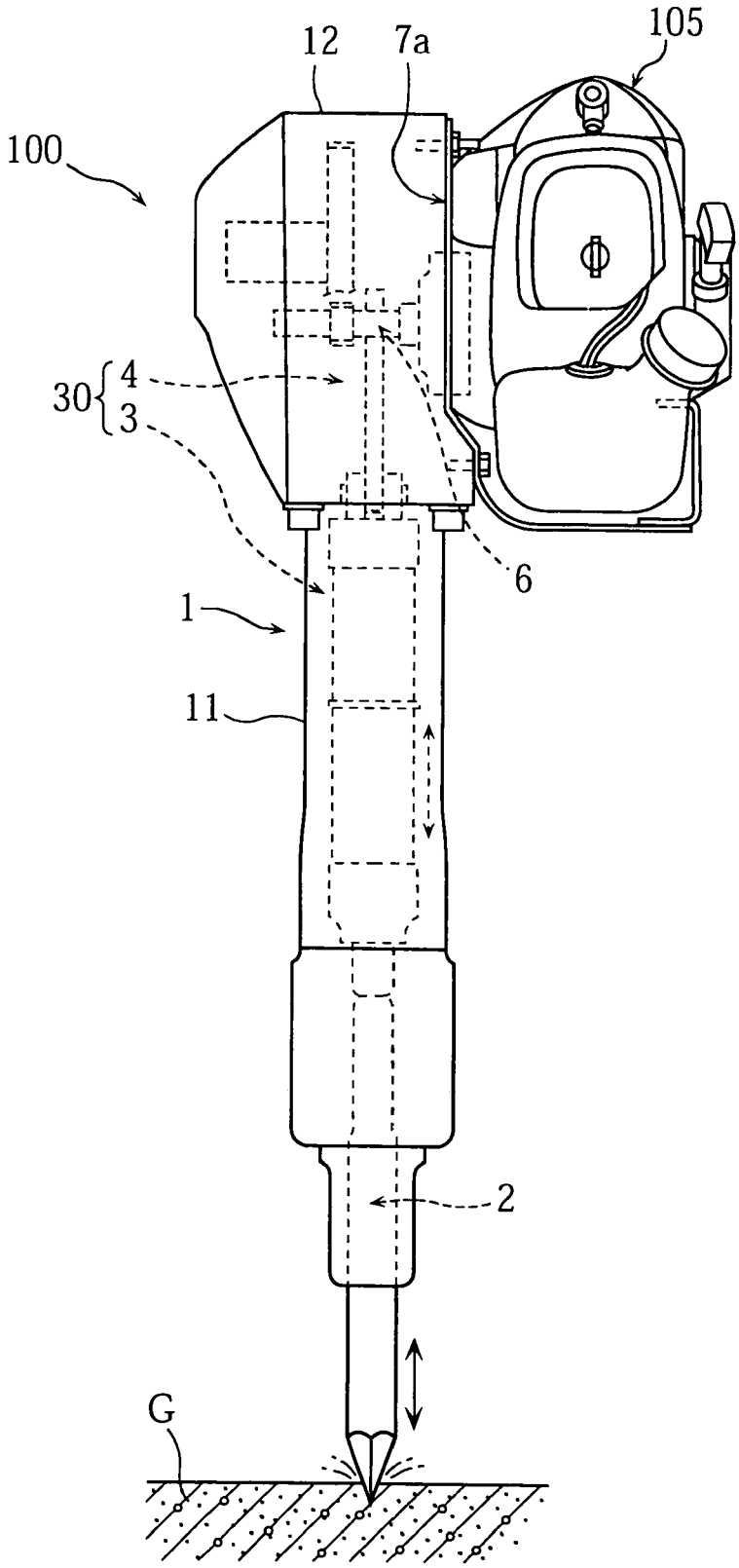
FIG.9 Prior Art
FIG. 9 is a side view illustrating an example of prior art engine breaker.

FIGS. 6–8 illustrate another example of flexible coupling 9. In this flexible coupling 9B, the end of the clutch drum 52 on the side of the rotary shaft 6 is in the form of a boss. The boss end 53 has an inner circumferential surface formed with a plurality of radially extending first projections 53*a*. A bearing 54 is attached to the engine mount plate 7*a* with screws 55, and the boss end 53 is fitted in the bearing 54. A coupler 63 is fitted around an end of the rotary shaft 6. The coupler 63 is formed with a plurality of axially extending second projections 63*a* provided correspondingly to the first projections 53*a*. The coupler 63 is fitted in the clutch drum 52 with each of the second projections 63*a* received in the boss end 53 and located between two adjacent first projections 53*a*. The outer diameter of the coupler 63 at the portion formed with the second projections 63*a* is made slightly smaller than the inner diameter of the boss end 53.

The flexible coupling 9B includes a vibration absorber 91B comprising a generally columnar core 93*b* and a plurality of frill-like vibration absorbing portions 93*a* projecting from the circumferential surface of the core 93*b*. The vibration absorber is disposed in the boss end 53 in fitting the coupler 63 into the clutch drum 52. At this time, each of the vibration absorbing portions 93*a* is fitted between a side surface of a respective first projection 53*a* of the boss end 53 and a side surface of the adjacent second projection 63*a* of the coupler 63. The thickness of the vibration absorber 91B is so set that the front end of each second projection 63*a* of the coupler 63 does not come into contact with a bottom surface of the boss end 53 of the clutch drum 52.

In the flexible coupling 9B, when the positional deviation of the rotary shaft 6 (coupler 63) relative to the clutch drum 52 (boss end 53) occurs, the vibration absorbing portion 93*a* of the vibration absorber 91B is resiliently deformed between the first projection 53*a* and the second projection 63*a*. As a result, the load applied to the connection portion in the direction crossing the rotary shaft 6 is reduced. Since the boss end 53 and the coupler 63 are not connected to each other by mechanical means, the output shaft (clutch drum 52) of the engine 5 and the rotary shaft 6 can be easily separated from each other.

To break a hard object G such as asphalt or concrete using the engine breaker A, the speed of the engine 5 is increased with the front end of the work member 2 pressed against the hard object G, as shown in FIG. 1. When the speed of the engine 5 is increased from an idling state to reach a predetermined speed, the clutch drum 52 rotates by the operation of the centrifugal clutch, whereby the rotary shaft 6 connected to the drum via the flexible coupling 9 rotates. As a result, the crank plate 41 of the crank mechanism 4 rotates to cause the movable cylinder 31 to move up and down. As the movable cylinder 31 moves upward from the lower dead point, the lower pneumatic chamber 36 is compressed due to the inertial delay of the free piston 32. The compression continues until the movable cylinder 31 comes close to the upper dead point, and in the next moment, the free piston 32 moves upward at high speed due to the expansion force of the lower pneumatic chamber 36. When the movable cylinder 31 having reached the upper dead point begins to move downward, the upper pneumatic chamber 35 is maximally compressed due to the kinetic energy of the free piston 32 moving upward at high speed and the force of the crank mechanism 4 for pushing the movable cylinder 31 downward. In the next moment, the free piston 32 is quickly accelerated downward due to the strong expansion force of the upper pneumatic chamber 35. When the speed of the free piston 32 becomes maximum, the striking bar 33 strikes the upper end surface of the work member 2 strongly. By repeating this operation, the work member 2 successively applies impact force to the hard object G to break the object.

In breaking the hard object G in the above-described manner, the main body 1 vibrates up and down due to the reaction to the rapid acceleration of the free piston 32 and the impact of the striking of the upper end of the work member 2 by the striking bar 33. However, since the housing 5*a* of the engine 5 is mounted to the main body 1 via the resilient members 8, the vibration of the main body 1 is absorbed by the resilient members 8. Specifically, the resilient members 8 as small resilient pieces are interposed between the side surface of the housing 5*a* of the engine 5 and the side surface of the crank case 12 of the main body 1, and between the lower-surface side of the housing and the engine bracket 7*b*. Thus, the engine 5 is held by the main body 1 as suspended therefrom. With this arrangement, when the main body 1 vibrates, each of the resilient members 8 is instantaneously deformed to absorb the vibration. Therefore, it is possible to prevent the deformation of the housing 5*a* of the engine 5 at a portion close to the main body 1 or the vibration of the engine 5 itself which may cause a change in the positional relationship between the structural parts of the engine disposed inside or outside of the housing. Accordingly, the malfunction or failure of the engine 5 can be avoided. Therefore, as the engine 6, it is possible to use a small, widely available engine having a housing of a relatively small thickness, such as an engine for a mowing machine or a pump engine.

When the resilient member 8 is deformed in absorbing the vibration of the main body 1, positional deviation of the rotary shaft 6 in the main body 1 relative to the clutch drum 52 of the engine 5 occurs. Therefore, a load in the direction crossing the rotary shaft 6 is applied to the connection portion between the rotary shaft 6 and the clutch drum 52. However, the load applied to the connection portion between the rotary shaft 6 and the clutch drum 52 can be absorbed by flexible coupling 9 interposed between the rotary shaft 6 and the clutch drum 52. Therefore, the breakage at the connection portion can be avoided.

As described above, the engine breaker A is vibration-resistant.

The present invention is not limited to the foregoing embodiments, and any modification to the design within the range of the following claims is intended to be included in the scope of the present invention.

The invention claimed is:

1. An engine breaker comprising:

a vertically extending cylindrical main body;

a work member supported by a lower portion of the main body for up and down movement;

an engine mounted to an upper portion of the main body and having an output shaft arranged to extend horizontally; and a striker incorporated in the main body for successively striking an upper end of the work member through rotation of a horizontally extending rotary shaft to which rotation output of the engine is transmitted;

wherein the engine includes a housing supported by the main body via a resilient member, and a flexible coupling for absorbing vibration in a direction crossing the rotary shaft is interposed between the output shaft and the rotary shaft;

wherein the flexible coupling comprises a vibration absorber made of a resilient material and interposed between the rotary shaft and an output transmitting portion provided at the output shaft of the engine for transmitting output to the rotary shaft;

wherein an engine mount plate is provided for mounting the engine to the main body, the engine mount plate being provided with a bearing arranged between the side surface of the engine and the side surface of the main body;

wherein the output transmitting portion has an end in a form of a boss fitted in the bearing and having an inner circumferential surface formed with a plurality of radically extending first projections;

wherein the rotary shaft has an end formed with a plurality of axially extending second projections provided correspondingly to the first projections, each of the second projections being received in the boss end of the output transmitting portion and located between adjacent first projections; and wherein the vibration absorber includes a plurality of vibration absorbing portions each of which is arranged between a side surface of a respective one of the first projections and a side surface of the adjacent second projection in the boss end of the output transmitting portion.

2. An engine breaker comprising:

a vertically extending cylindrical main body;

a work member supported by a lower portion of the main body for up and down movement;

an engine mounted to an upper portion of the main body and having an output shaft arranged to extend horizontally; and a striker incorporated in the main body for successively striking an upper end of the work member through rotation of a horizontally extending rotary shaft to which rotation output of the engine is transmitted;

wherein the engine includes a housing supported by the main body via a first resilient member and a second resilient member, the first resilient member having a first orientation, the second resilient member having a second orientation that is perpendicular to the first orientation; wherein a flexible coupling for absorbing vibration in a direction crossing the rotary shaft is interposed between the output shaft and the rotary shaft;

wherein the flexible coupling comprises an annular vibration absorber made of a resilient material and interposed between the rotary shaft and an output transmitting portion provided at the output shaft of the engine for transmitting output to the rotary shaft; and wherein the vibration absorber is fitted around an end of the rotary shaft and has an end surface contacting and fixed to the output transmitting portion, the vibration absorber being fixed to the end of the rotary shaft by a first group of screws extending radially of the annular vibration absorber, the vibration absorber being fixed to the output transmitting portion by a second group of screws extending axially of the annular vibration absorber.

3. The engine breaker according to claim 2, wherein the housing of the engine includes a side surface and a lower surface respectively supported, via the first and second resilient members, by a side surface of the main body and an engine bracket standing from the side surface of the main body.

4. The engine breaker according to claim 2, wherein the striker includes a crank mechanism operated by rotation of the rotary shaft, and a hammer which moves up and down by the operation of the crank mechanism.

* * * * *